US009831565B2

(12) United States Patent
Tageman et al.

(10) Patent No.: US 9,831,565 B2
(45) Date of Patent: Nov. 28, 2017

(54) SIW ANTENNA ARRANGEMENT

(71) Applicant: TELEFONAKTIEBOLAGET L M ERICSSON (PUBL), Stockholm (SE)

(72) Inventors: Ola Tageman, Göteborg (SE); Per Ligander, Göteborg (SE); Lars Manholm, Göteborg (SE); Valter Pasku, Fier (AL); Ove Persson, Hunnebostrand (SE); Pietro Sanchirico, Corciano (IT)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 108 days.

(21) Appl. No.: 14/779,298

(22) PCT Filed: Mar. 24, 2013

(86) PCT No.: PCT/EP2013/056173
§ 371 (c)(1),
(2) Date: Sep. 22, 2015

(87) PCT Pub. No.: WO2014/154231
PCT Pub. Date: Oct. 2, 2014

(65) Prior Publication Data

US 2016/0056541 A1 Feb. 25, 2016

(51) Int. Cl.
*H01Q 21/00* (2006.01)
*H01Q 13/18* (2006.01)
(Continued)

(52) U.S. Cl.
CPC ..... *H01Q 21/0068* (2013.01); *H01P 3/16* (2013.01); *H01P 11/006* (2013.01); *H01Q 9/045* (2013.01); *H01Q 13/18* (2013.01); *H01Q 21/064* (2013.01)

(58) Field of Classification Search
CPC .. H01P 3/12; H01P 3/121; H01P 3/122; H01P 3/16; H01P 3/165; H01Q 9/045;
(Continued)

(56) References Cited

U.S. PATENT DOCUMENTS 3,906,502 A * 9/1975 Connolly ..... H01Q 3/34 342/372
6,297,774 B1 * 10/2001 Chung ..... H01Q 21/0087 343/700 R
(Continued)

OTHER PUBLICATIONS

Notification of Transmittal of the International Search Report dated Oct. 9, 2013, in International Application No. PCT/EP2013/056173, 4 pages.
(Continued)

*Primary Examiner* — Tho G Phan
*Assistant Examiner* — Patrick Holecek
(74) *Attorney, Agent, or Firm* — Rothwell, Figg, Ernst & Manbeck, P.C.

(57) ABSTRACT

An antenna arrangement comprising a SIW with at least one radiating arrangement. The SIW comprises a dielectric material, a first and second metal layer and a first and second electric wall element running essentially parallel and electrically connecting the metal layers. For each radiating arrangement, the antenna arrangement comprises at least one coupling aperture in the first metal layer, and for each coupling aperture there is a third wall element running between the first and second electric wall elements, across a SIW longitudinal extension ($e_s$). For each radiating arrangement, the antenna arrangement further comprises an at least partly electrically conducting antenna component which comprises at least four radiating elements and is surface-mounted on the first metal layer, enclosing at least one coupling aperture. For each radiating arrangement, electro-
(Continued)

magnetic signals are arranged to be transmitted between said coupling aperture and said radiating elements.

14 Claims, 11 Drawing Sheets

(51) Int. Cl.

| | |
|---|---|
| ***H01Q 21/06*** | (2006.01) |
| ***H01P 3/16*** | (2006.01) |
| ***H01P 11/00*** | (2006.01) |
| ***H01Q 9/04*** | (2006.01) |

(58) Field of Classification Search
CPC ..... H01Q 9/0457; H01Q 13/18; H01Q 13/22; H01Q 21/0043; H01Q 21/005; H01Q 21/0062; H01Q 21/0068; H01Q 21/064; H01Q 21/065
See application file for complete search history.

(56) References Cited

U.S. PATENT DOCUMENTS

| | | | | |
|---|---|---|---|---|
| 8,120,537 | B2 * | 2/2012 | del Rio | H01Q 5/00 343/700 MS |
| 8,542,151 | B2 * | 9/2013 | Lin | H01Q 9/045 343/700 MS |
| 8,797,126 | B2 * | 8/2014 | Gevorgyan | H01P 1/207 333/209 |
| 2004/0041663 | A1 | 3/2004 | Uchimura et al. | |
| 2012/0242547 | A1 | 9/2012 | Fujii et al. | |

OTHER PUBLICATIONS

Olivier Kramer et al: "Very Small Footprint 60 GHz Stacked Yagi Antenna Array", IEEE Transactions on Antennas and Propagation, IEEE Service Center, Piscataway, NJ, US, vol. 59, No. 9, Sep. 1, 2011 (Sep. 1, 2011), pp. 3204-3210, XP011359285,ISSN: 0018-926X, DOI: 10.1109/TAP.2011.2161562 * Section III 4 X 4 Yagi Antenna array using SIW feeding mechanism *; figures 1,7,9.

Yohei Miura et al: "A 60GHz double-layer waveguide slot array with more than 32dBi and 80% efficiency over 5GHz bandwidth fabricated by diffusion bonding of laminated thin metal plates", Antennas and Propagation Society International Symposium (APSURSI), 2010 IEEE, IEEE, Piscataway, NJ, USA, Jul. 11, 2010 (Jul. 11, 2010), pp. 1-4, XP031745035,ISBN: 978-1-4244-4967-5.

Wael M Abdel-Wahab et al: "Low cost 60GHz millimeter-wave microstrip patch antenna array using low-loss planar feeding scheme", Antennas and Propagation (APSURSI), 2011 IEEE International Symposium on, IEEE, Jul. 3, 2011 (Jul. 3, 2011), pp. 508-511, XP032191467, DOI: 10.1109/APS.2011.5996756 ISBN: 978-1-4244-9562-7, abstract; figures 1, 2.

Miura Y et al: Bandwith of a four-aperture element for a double-layer corporate-feed hollow-waveguide slot array, Antennas and Propagation Society International Symposium, 2009. APSURSI'09. IEEE, IEEE, Piscataway, NJ, USA, Jun. 1, 2009 (Jun. 1, 2009), pp. 1-4, XP031536073, ISBN: 978-1-244-3647-7 abstract; figure 2.

Yohei Miura et al: "A High-Efficiency Circularly-Polarized Aperture Array Antenna with a Corporate-Feed Circuit in the 60 GHz Band", IEICE Transactions on Electronics, Institute of Electronics, Tokyo, JP, vol. E94C, No. 10, Oct. 1, 2011 (Oct. 1, 2011), pp. 1618-1625, XP001570501, ISSN: 0916-8524, DOI:10.1587/TRANSELE.E94.C.1618 [retrieved on Oct. 1, 2011] abstract; figure 1.

Jiro Hirokawa et al. "Plate-laminated-waveguide corporate-feed slot array antennas with a polarization conversion layer", 2011 IEEE MTT-S International Microwave Workshop Series on Millimeter Wave Integration Technologies, pp. 29-32.

Yohei Miura et al. "Double-Layer Full-Corporate-Feed Hallow-Waveguide Slot Array Antenna in the 60-GHz Band", IEEE Transactions on Antennas and Propagation, vol. 59, No. 8, Aug. 2011, pp. 2844-2851.

Jungfeng Xu et al. "Bandwidth Enhancement for a 60 GHz Substrate Integrated Waveguide Fed Cavity Array Antenna on LTCC", IEEE Transactions on Antennas and Propagation, vol. 59, No. 3, Mar. 2011, pp. 826-832.

Dongjin Kim et al. "Feeding Structure to Widen Bandwidth for Dual-polarization Corporate-feed Waveguide Slot Array Antenna", Dept. of Electrical and Electronic Eng., Tokyo Institute of Technology, 2011, 4 pages.

Takashi Tomura et al. "Height Reduction in a 2x2-element Subarray for a Corporate-feed Plate-laminated-waveguide 45-degree Linearly-polarized Slot Array", Dept. of Electrical and Electronic Eng., Tokyo Institute of Technology, 2011, 5 pages.

Takashi Tomura et al. "Design of a 45-degree Linearly-polarized Hollow-waveguide Slot Two-dimensional Array Antenna with a Full-corporate-feed Circuit in the Lower Layer", Dept. of Electrical and Electronic Eng., Tokyo Institute of Technology, 2010, 4 pages.

Jiro Hirokawa "Analysis and Fabrication of Millimeter-Wave Slotted Waveguide Array Antennas", 2010 IEEE URSI International Symposium on Electromagnetic Theory, pp. 906-909.

K. Shambavi et al. "Design and Analysis of High Gain Millimeter Wave Microstrip Antenna Array for Wireless Applications", Journal of Theoretical and Applied Information Technology, 2005-2009, pp. 159-164.

J. Säily et al. "Low cost high gain antenna arrays for 60 GHz millimeter wave identification (MMID)" VTT Technical Research Centre of Finland and Taconic ADD, 2011, 6 pages.

M. B. Gueye et al. "Antenna array for Point-to-Point Communication in E-band frequency range", 2011 IEEE, pp. 2077-2079.

Jiro Hirokawa "Plate-laminated Waveguide Slot Array Antennas and its Polarization Conversion Layers" Online ISSN 1848-3380, Print ISSN 0005-1144, ATKAFF 53(1), 2012, pp. 9-19.

* cited by examiner

Section A-A

Section A-A

SIW ANTENNA ARRANGEMENT

CROSS REFERENCE TO RELATED APPLICATION(S)

This application is a 35 U.S.C. §371 National Phase Entry Application from PCT/EP2013/056173, filed Mar. 24, 2013, designating the United States, the disclosure of which is incorporated herein in its entirety by reference.

TECHNICAL FIELD

The present invention relates to an antenna arrangement comprising a substrate integrated waveguide, SIW, with at least one radiating arrangement. The SIW comprises a dielectric material, a first metal layer, a second metal layer and an electric wall element arrangement. The dielectric materiel 4 has a layer thickness and is positioned between the first metal layer and the second metal layer. The electric wall element arrangement comprises a first electric wall element and a second electric wall element, the first electric wall element and the second electric wall element at least partly running mutually parallel, separated by a SIW width, in a SIW longitudinal extension and electrically connecting the first metal layer with the second metal layer. Microwave signals are arranged to propagate along the SIW longitudinal extension in a confinement limited by at least the first metal layer, the second metal layer, the first electric wall element and the second wall element. For each radiating arrangement, the antenna arrangement comprises at least one coupling aperture in the first metal layer, and for each coupling aperture there is a third wall element running between the first electric wall element and the second wall element across the SIW longitudinal extension.

The present invention relates to a method for assembling an antenna arrangement the method comprising the steps:

forming a substrate integrated waveguide, SIW, with at least one radiating arrangement, the SIW having a dielectric material, a first metal layer, a second metal layer and an electric wall element arrangement. The dielectric materiel has a layer thickness and is positioned between the first metal layer and the second metal layer, the electric wall element arrangement comprising a first electric wall element and a second electric wall element, the first electric wall element and the second electric wall element at least partly running mutually parallel, separated by a SIW width, in a SIW longitudinal extension and electrically connecting the first metal layer with the second metal layer. Microwave signals are arranged to propagate along the SIW longitudinal extension in a confinement limited by at least the first metal layer, the second metal layer, the first electric wall element and the second wall element;

for each radiating arrangement, forming at least one coupling aperture in the first metal layer; and for each coupling aperture, forming a third wall element running between the first electric wall element and the second wall element, across the SIW longitudinal extension.

BACKGROUND

In many fields of communication, a suitable antenna is desired. Flat, robust and lightweight antennas are desired for many applications, especially in the millimeter wave range with frequencies around 30-300 GHz, in particular 60 GHz and 70/80 GHz. Such an antenna should further be inexpensive to manufacture and still have good electric properties with respect to bandwidth, loss and matching.

Such an antenna should preferably have tightly integrated RF-circuits and duplex filters, beyond connecting parts with waveguide interface.

One way to accomplish such antennas is by using a so-called substrate integrated waveguide, SIW, as a base, which has many advantages. SIW antennas with multilayer boards having a SIW distribution network, hierarchal arrangement to allow equal length of propagation to all elements, and additional circuit board layers that contain radiating structures, are previously known. However, such structures suffer from tolerance problems and high manufacturing costs. Other previously known antennas based on SIW technology also suffer from narrow-banded functionality.

There is thus a desire to provide an antenna arrangement based on SIW technology, with improvements with regards to the mentioned issues.

SUMMARY

It is an object of the present invention to provide an antenna arrangement based on SIW technology, which has improved qualities with respect to previously known arrangements.

Said object is obtained by means of an antenna arrangement comprising a substrate integrated waveguide, SIW, with at least one radiating arrangement. The SIW comprises a dielectric material, a first metal layer, a second metal layer and an electric wall element arrangement. The dielectric materiel 4 has a layer thickness and is positioned between the first metal layer and the second metal layer. The electric wall element arrangement comprises a first electric wall element and a second electric wall element, the first electric wall element and the second electric wall element at least partly running mutually parallel, separated by a SIW width, in a SIW longitudinal extension and electrically connecting the first metal layer with the second metal layer. Microwave signals are arranged to propagate along the SIW longitudinal extension in a confinement limited by at least the first metal layer, the second metal layer, the first electric wall element and the second wall element. For each radiating arrangement, the antenna arrangement comprises at least one coupling aperture in the first metal layer, and for each coupling aperture there is a third wall element running between the first electric wall element and the second wall element across the SIW longitudinal extension.

Furthermore, for each radiating arrangement, the antenna arrangement further comprises an at least partly electrically conducting antenna component, the antenna component comprising at least four radiating elements and being surface-mounted on the first metal layer, enclosing at least one coupling aperture. For each radiating arrangement, electromagnetic signals are arranged to be transmitted between said coupling aperture and said radiating elements.

Said object is also obtained by means of a method for assembling an antenna arrangement the method comprising the steps:

forming a substrate integrated waveguide, SIW, with at least one radiating arrangement, the SIW having a dielectric material, a first metal layer, a second metal layer and an electric wall element arrangement. The dielectric materiel has a layer thickness and is positioned between the first metal layer and the second metal layer, the electric wall element arrangement comprising a first electric wall element and a second electric wall element, the first electric wall element and the second electric wall element at least partly running mutually parallel, separated by a SIW width, in a SIW longitudinal extension and electrically connecting the first metal layer with the second metal layer. Microwave signals are arranged to propagate along the SIW longitudinal extension in a confinement limited by at least the first metal layer, the second metal layer, the first electric wall element and the second wall element;

for each radiating arrangement, forming at least one coupling aperture in the first metal layer, and for each coupling aperture, forming a third wall element running between the first electric wall element and the second wall element, across the SIW longitudinal extension.

For each radiating arrangement, the method further comprises the step of surface-mounting an at least partly electrically conducting antenna component with at least four radiating elements on at least one coupling aperture.

According to an example, each antenna component comprises a multiple of four radiating elements.

According to another example, the antenna arrangement comprises a SIW distribution network and at least one SIW port. The distribution network is arranged to transfer signals between each SIW port and a plurality of coupling apertures.

According to another example, the antenna arrangement comprises a SIW duplex filter or, alternatively, a surface-mounted duplex filter connected to said port.

According to another example, said SIW port may be in the form of a waveguide interface formed in one of the metal layers.

According to another example, each antenna component comprises a cavity defined by at least partly electrically conducting walls. The radiating elements are in the form of slots in one of said walls.

Alternatively, each antenna component comprises a dielectric material layer, the radiating elements being the form of electrically conducting patches formed on the dielectric material layer.

Other examples are disclosed in the dependent claims.

A number of advantages are obtained by means of the present invention. For example:

- Flat, since the thickness of the board and radiators together can be less than one wave-length.
- Lightweight, since the volume is small. The design enables a large fraction of it to be plastic.
- The board has low complexity, does not require several accurately aligned layers.
- The radiating components can be made in one single milling operation.
- Enables low cost, since assembly may be made in a standard assembly process for circuit board assemblies.
- Enables wide band operation, since a hierarchal distribution network may be used.
- Low loss, since effects of strip edge and nickel-based plating is absent.
- Good matching, since tolerances are good and the bandwidth margin is good.
- Allows tight integration with RF-circuits and duplex filters into antenna, beyond connecting parts with waveguide interface, since filters can be made either in SIW technology or as surface mount cavity components, and since RF-circuits can be added in the same process as the radiating components or as chip-on-board techniques, for example chip-pocket and wire bonding, flip chip, or surface mount packages.
- Millimeter wave capable, 30-300 GHz, in particular 60 GHz and 70/80 GHz, since tolerances are tight, and the loss is acceptably low.
- Mechanically robust, since circuit boards can be metal-backed or glass fiber reinforced and contain materials that are not fragile, in contrast to antennas based on molded plastics or ceramic materials.

BRIEF DESCRIPTION OF THE DRAWINGS

The present invention will now be described more in detail with reference to the appended drawings, where.

DETAILED DESCRIPTION

Figure 1:
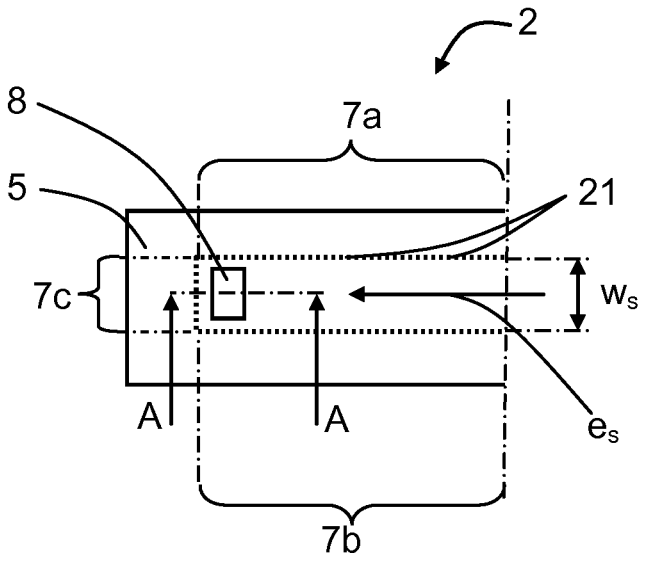
FIG. 1 schematically shows a top view of a SIW with a coupling aperture.
Figure 2:
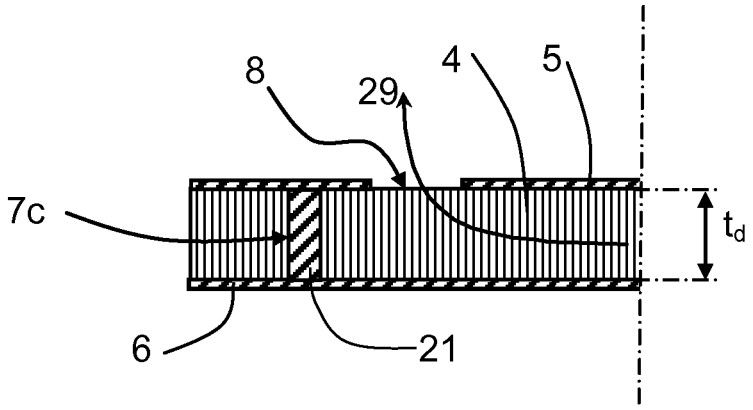
FIG. 2 schematically shows a sectional side view of FIG. 1.

With reference to FIG. 1 and FIG. 2, a substrate integrated waveguide, a SIW, is a waveguide defined by at least two parallel walls located in the dielectric between two electrically conductive layers.

More in detail, the SIW 2 comprises a dielectric material 4, a first metal layer 5 and a second metal layer 6, where the dielectric materiel 4 has a layer thickness $t_d$ and is positioned between the first metal layer 5 and the second metal layer 6. The SIW also comprises an electric wall element arrangement 7*a*, 7*b*, 7*c* in the form of vias 21 that run through the dielectric material 4 and electrically connect the metal layers 5, 6. The electric wall element arrangement comprises a first electric wall element 7*a* and a second electric wall element 7*b*, where the first electric wall element 7*a* and the second electric wall element 7*b* run mutually parallel, separated by a SIW width $w_s$ in a SIW longitudinal extension $e_s$.

Microwave signals 29 are arranged to propagate along the SIW longitudinal extension $e_s$ in a confinement limited by at least the first metal layer 5, the second metal layer 6, the first electric wall element 7*a* and the second wall element 7*b*.

As a part of an antenna arrangement 1 with at least one radiating arrangement 3, which antenna arrangement 1 will be described more in detail later, for each radiating arrangement, the SIW 2 comprises a coupling aperture 8 in the first metal layer 5, and a third wall element 7*c* also being in the form of vias 21 that run through the dielectric material 4 and electrically connect the metal layers 5, 6. The third wall element 7*c* is running between the first electric wall element 7*a* and the second wall element 7*b*, across the SIW longitudinal extension $e_s$. Microwave signals 29 propagating in the SIW 2 are thus directed to run via the coupling aperture 8.

According to the present invention, with reference to FIG. 3, FIG. 4, FIG. 5, FIG. 6 and FIG. 7, for each radiating arrangement 3, the antenna arrangement 1 comprises an electrically conducting antenna component 9 which comprises four radiating elements 10*a*, 10*b*, 10*c*, 10*d*. Each antenna component 9 is surface-mounted on the first metal layer 5, enclosing the coupling aperture 8. For each radiating arrangement, electromagnetic signals are arranged to be transmitted between the coupling aperture 8 and said radiating elements 10*a*, 10*b*, 10*c*, 10*d*.

Figure 3:
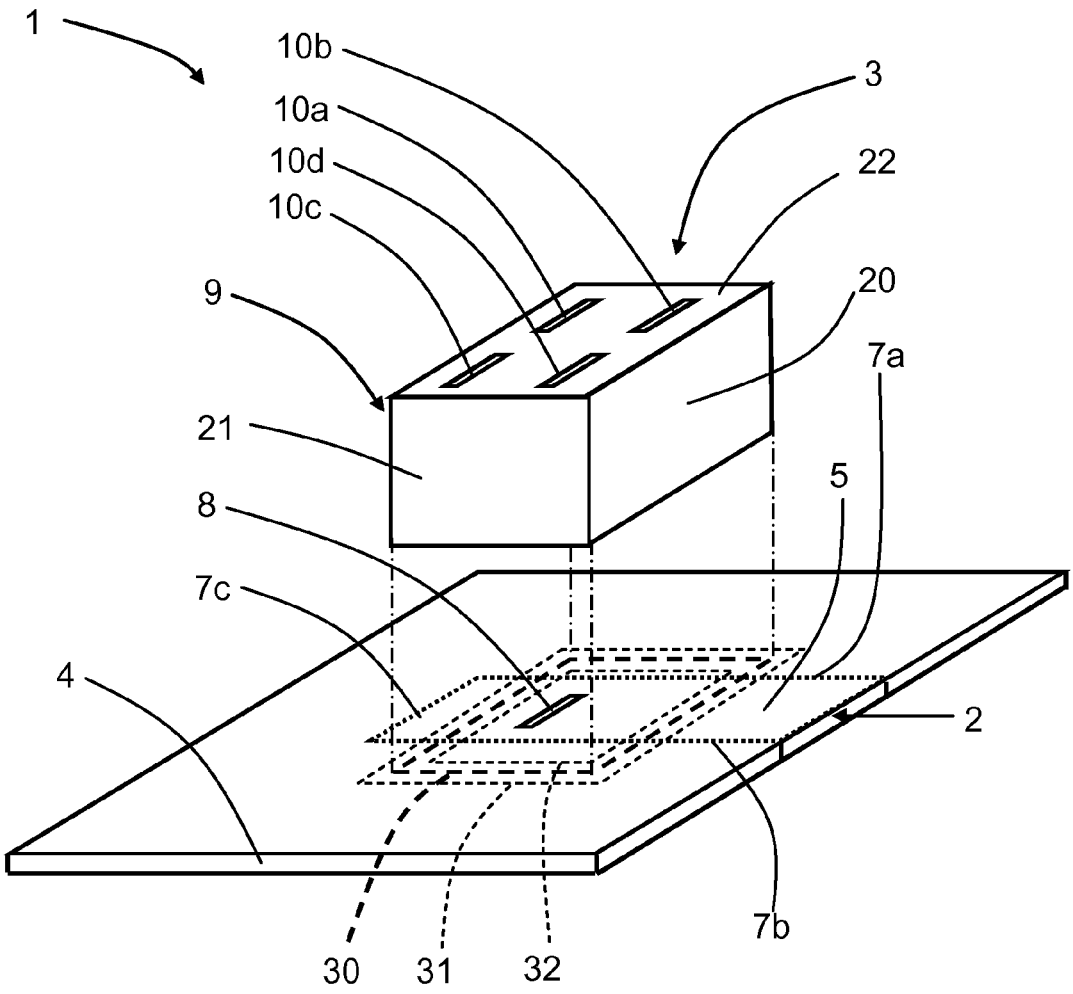
FIG. 3 schematically shows a perspective view of an antenna component to be mounted on the SIW-board over an aperture.
Figure 4:
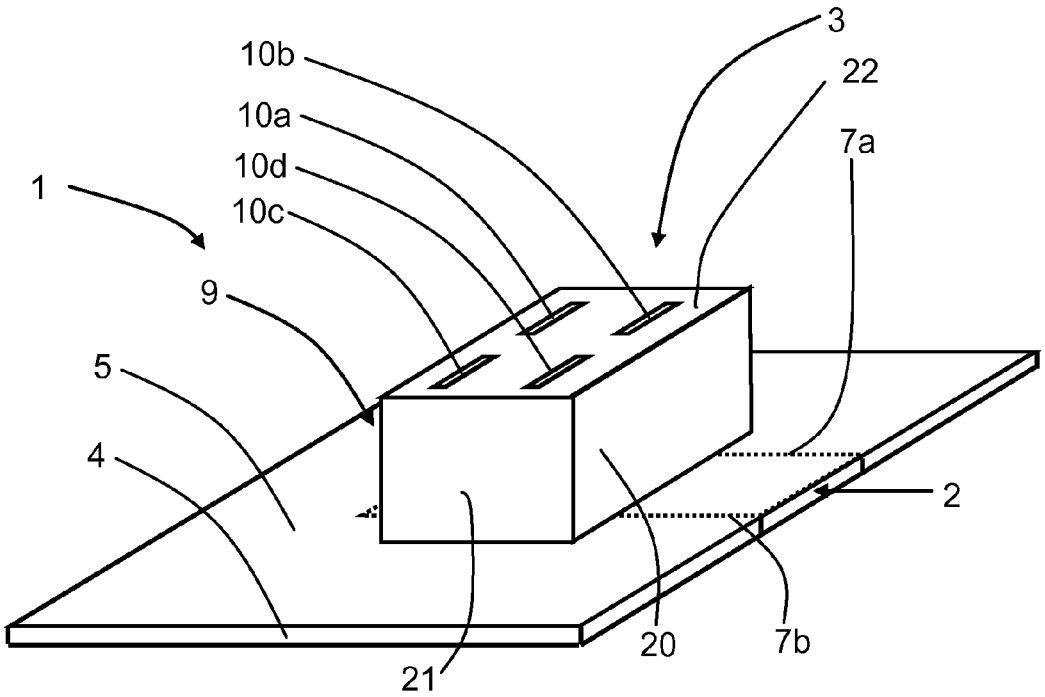
FIG. 4 schematically shows a perspective view of the antenna component after assembly to the SIW-board.
Figure 5:
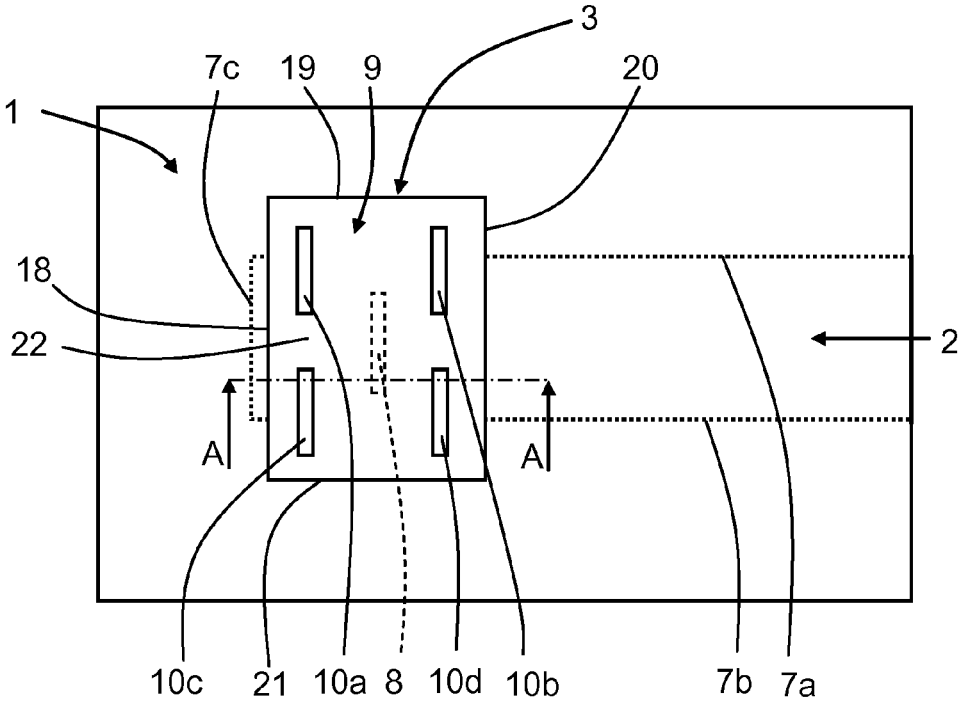
FIG. 5 schematically shows a top view of an antenna component mounted to the SIW.
Figure 6:
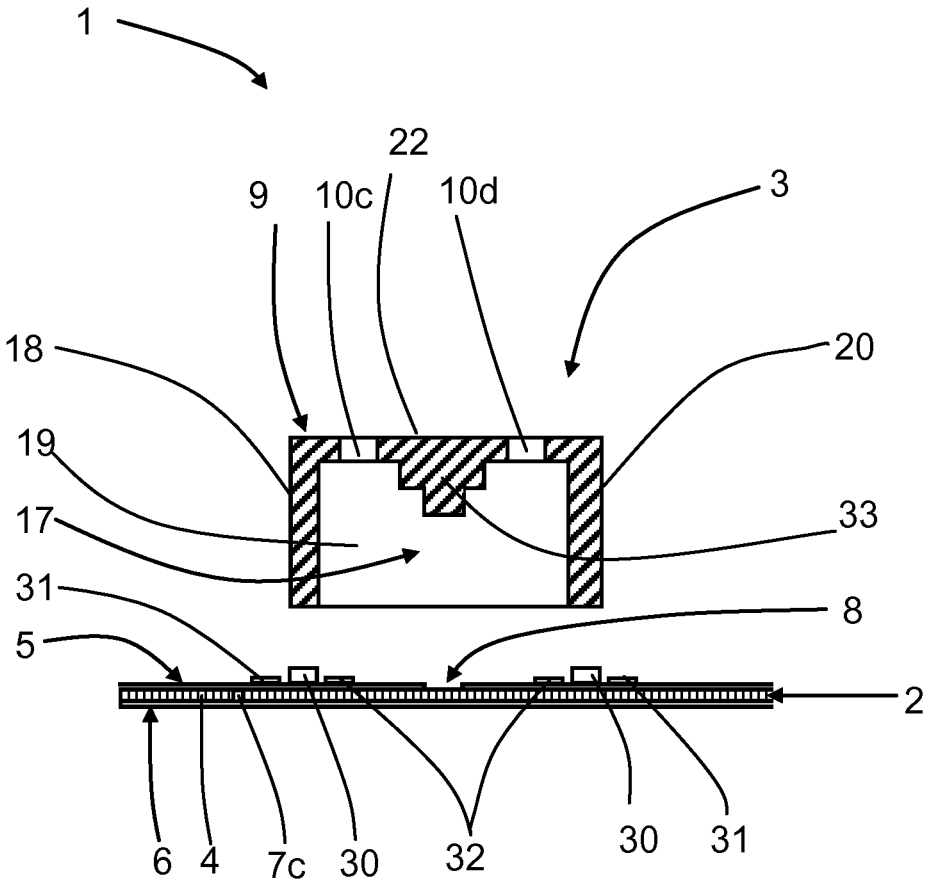
FIG. 6 schematically shows a sectional side view of FIG. 5 before assembly.
Figure 7:
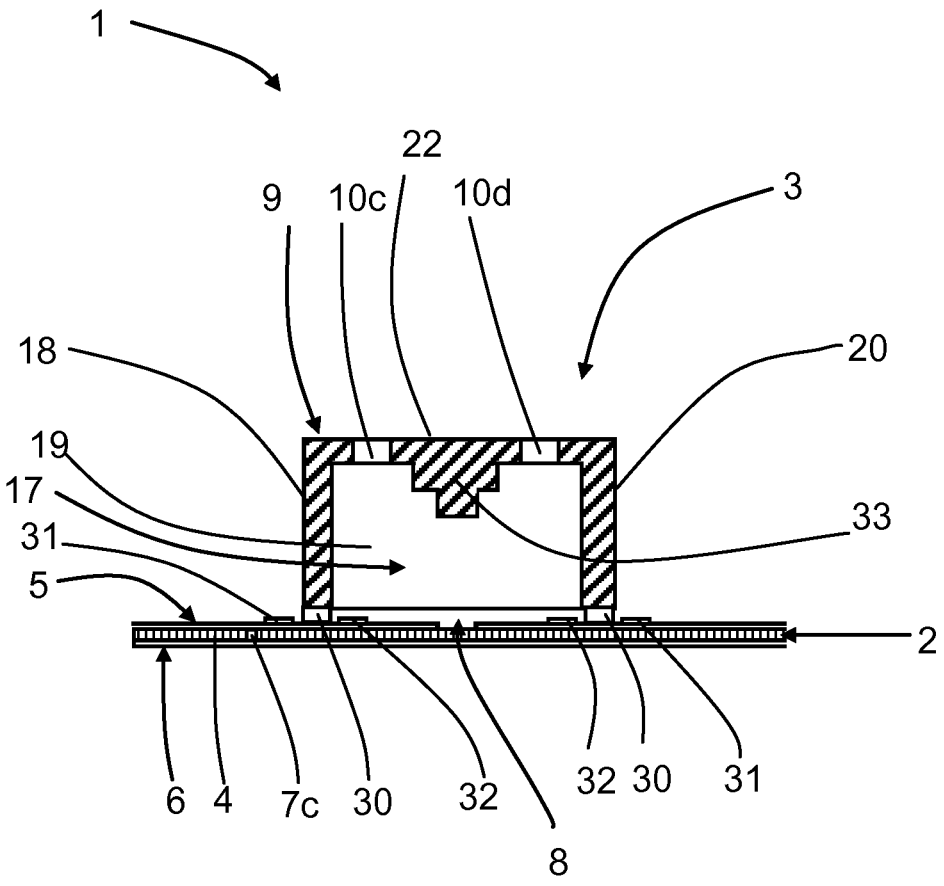
FIG. 7 schematically shows a sectional side view of FIG. 5 when being assembled.

More in detail, FIG. 3 shows a schematic perspective view of an antenna component 9 about to be mounted, and FIG. 4 shows the mounted antenna component 9. FIG. 5 shows a top view of the antenna component 9, either before or after mounting. FIG. 6 shows a section of FIG. 4 before mounting, and FIG. 7 shows the same section just before soldering. In the example shown, each antenna component 9 comprises a cavity 17 defined by electrically conducting walls 18, 19, 20, 21, 22, the radiating elements being in the form of slots 10*a*, 10*b*, 10*c*, 10*d* in one electrically conducting wall 22.

As schematically shown in FIG. 3, FIG. 6 and FIG. 7, there is solder 30 applied on the first metal layer 5, and the solder 30 is prevented to escape during reflow soldering by the help of solder mask areas 31, 32. The solder 30 and solder masks 31, 32 are not shown in any one of the other figures in order to keep them clear, although the solder 30 and solder masks 31, 32 should be regarded as present where applicable. As shown in FIG. 3, for each antenna component 9, the solder 30 is shown to follow the rectangular line shape of the outer walls 18, 19, 20, 21 of the antenna component, and the solder masks 31, 32 constitute frames surrounding the solder 30. The solder masks may have any suitable form, and may for example cover all metal areas where solder is not desired.

The use of solder 30 and solder masks 31, 32 is commonly known, and how they are applied here is not described in detail. However, an example of such a process may be:

Screen printing of solder paste.

Pick and place assembly of radiators.

Reflow soldering.

Self-aligning action due to surface tension pulling free-floating components in molten solder to the right position.

Good manufacturing yield may be acquired, since self-alignment is used for surface-mount (SMT) assembly. By providing antenna components in the form of self-aligned components like this, one eliminates the need to add more layers in the board, with stringent requirements on alignment between layers.

In FIG. 7, an antenna component 9 is shown in position just before soldering the antenna component 9 to the first metal layer 5. The soldering is made in a re-flow process, all antenna components have been positioned in a so-called pick & place process.

As shown in the section views in FIG. 6 and FIG. 7, each antenna component comprises matching steps 33 between the slots 10*a*, 10*b*, 10*c*, 10*d*.

In the following, antenna arrangements with a plurality of antenna components 9*a*, 9*b*, 9*c*, 9*d*; 9' being parts of corresponding radiating arrangements 3*a*, 3*b*, 3*c*, 3*d*; 3' will be described.

Figure 8:
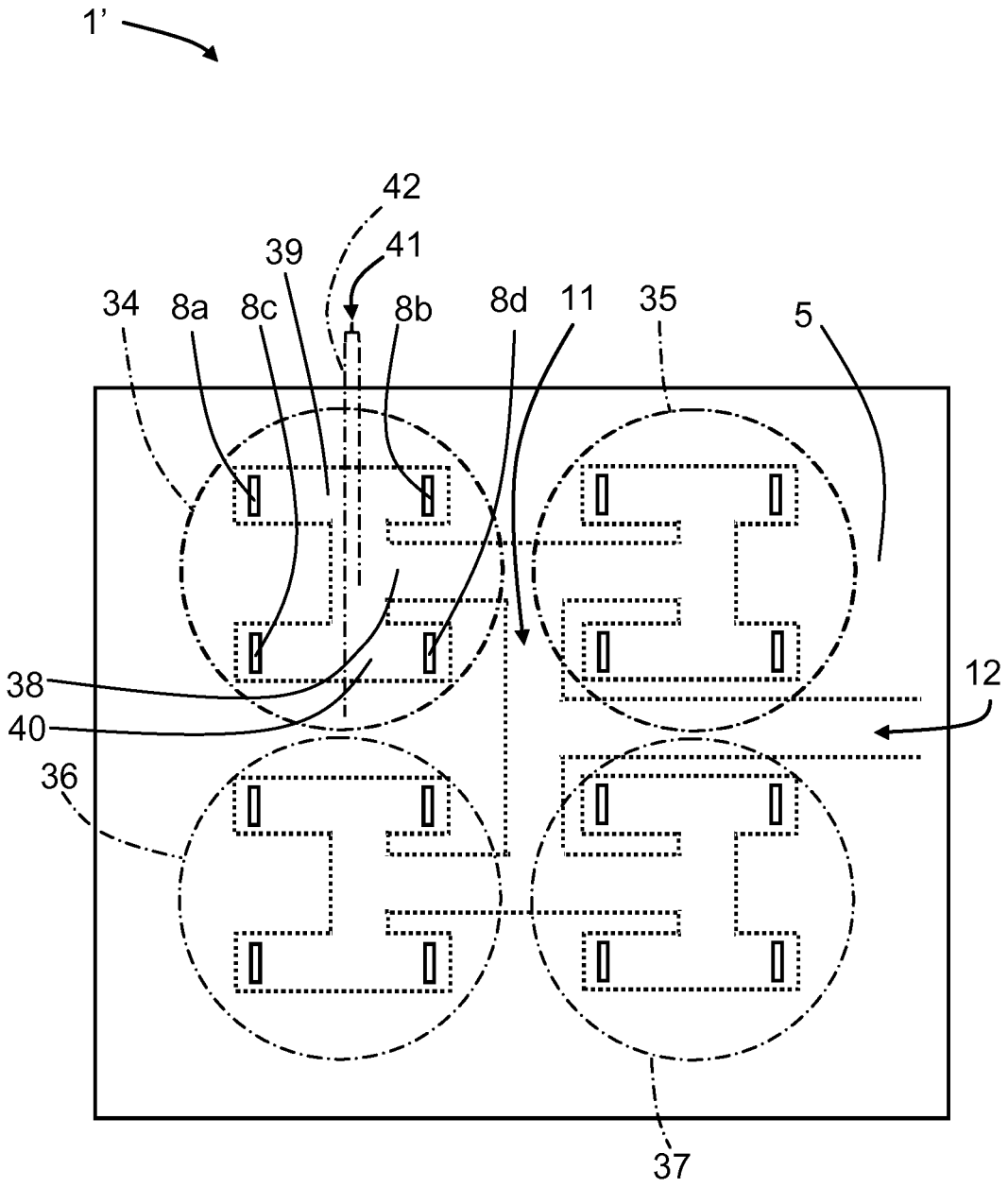
FIG. 8 schematically shows a top view of a SIW distribution network.

With reference to FIG. 8, there is an antenna arrangement 1' with a SIW distribution network 11 which connects a SIW port 12 to a plurality of coupling apertures 8*a*, 8*b*, 8*c*, 8*d* in a hierarchal manner. In FIG. 8, there are four groups 34, 35, 36, 37 of coupling apertures 8*a*, 8*b*, 8*c*, 8*d* with four coupling apertures in each group, only the coupling apertures 8*a*, 8*b*, 8*c*, 8*d* in the first group 34 are indicated in FIG. 8 for reasons of clarity, although there are sixteen coupling apertures present in this example. The first group 34 is fed by a first branch 38 that is divided into a second branch 39 and a third branch 40. The second branch 39 and the third branch 40 each comprises two coupling apertures 8*a*, 8*b*; 8*c*, 8*d*, one at each end. The first branch 38 is connected to the second branch 39 and the third branch 40 with a certain lateral offset 41 relative a symmetry line 42 dividing the second branch 39 and the third branch 40 in equal parts. This offset 41 is tuned such that all coupling apertures 8*a*, 8*b*; 8*c*, 8*d* are fed in phase. This arrangement is applied for all groups 34, 35, 36, 37 in the antenna arrangement 1'.

This means that electromagnetic signals are distributed in phase between the SIW port 12 and the coupling apertures 8*a*, 8*b*, 8*c*, 8*d* in all groups 34, 35, 36, 37 in the antenna arrangement 1'.

It is possible to deliberately set different amplitudes and different phases to different apertures, by adjusting the power-split ratios and adding filters in the SIW distribution network, in order to fine tune the radiation pattern. Is also possible to remove some of the antenna components provided one makes a corresponding compensation in the power-split ratios. This way it is possible to get a circular or rectangular antenna instead of a quadratic.

The coupling apertures can also be oriented in other ways such that no offsets are needed, the coupling apertures can for example extend longitudinally along their branches 39, 40.

Figure 9:
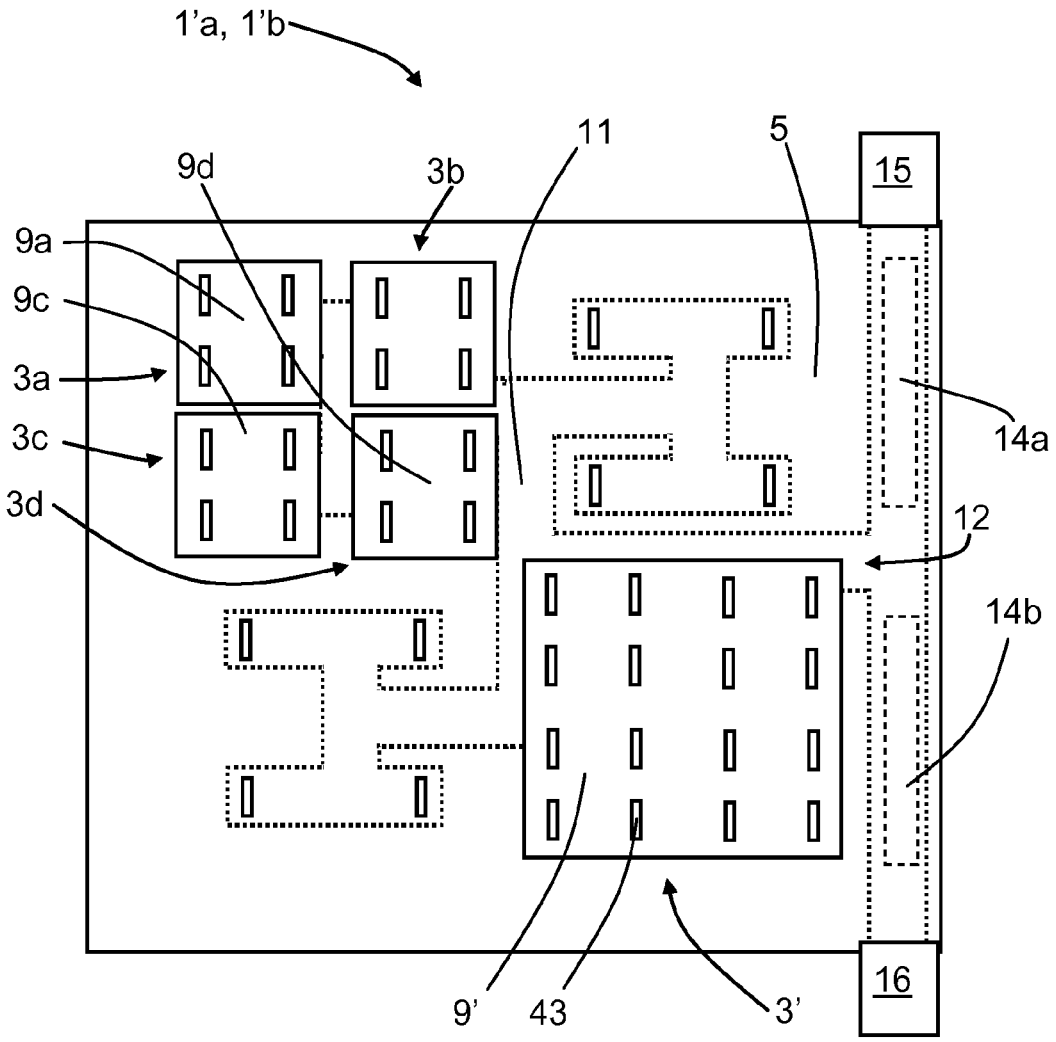
FIG. 9 schematically shows the view of FIG. 8 with examples of antenna components and filters mounted.

In FIG. 9, two different examples of radiating arrangements 3*a*, 3*b*, 3*c*, 3*d*; 3' are shown for the SIW distribution network 11 shown in FIG. 8. This is of course for reasons of explaining the present invention, normally only one type of radiating arrangement is used. Therefore, two types of antenna arrangements 1'*a*, 1'*b* are shown in the same Figure.

A first type of radiating arrangements 3*a*, 3*b*, 3*c*, 3*d* in a first type of antenna arrangement 1'*a* is of the type previously shown, where antenna components 9*a*, 9*b*, 9*c*, 9*d* of the type shown before is positioned over each coupling aperture 8*a*, 8*b*, 8*c*, 8*d* in the first type of antenna arrangement 1'*a*, one antenna component for each coupling aperture 8*a*, 8*b*, 8*c*, 8*d*. This is shown for the first group 34 according to FIG. 8, but for a real antenna arrangement, such antenna components 9*a*, 9*b*, 9*c*, 9*d* would be used for all groups 34, 35, 36, 37.

The second type of radiating arrangements 3' in a second type of antenna arrangement 1'*b* uses extended antenna components 9', each antenna component comprising a multiple of the four radiating elements 10*a*, 10*b*, 10*c*, 10*d* of the previously described antenna components; here each antenna component 9' comprises sixteen radiating elements 43 (only one antenna component indicated in FIG. 9), and is positioned over four coupling apertures in the antenna arrangement 1'*b*. This is shown for the fourth group 37 according to FIG. 8, but for a real antenna arrangement, such antenna components 9' would be used for all groups 34, 35, 36, 37.

As indicated above, other antenna components are conceivable; for example one large antenna component could be used for all coupling apertures. Which size that is used is for example determined by which manufacturing method that is chosen, and which frequency band that the antenna arrangement is intended for. The higher the frequency band is, the more the sense it makes to split in many sub-components in order to meet alignment requirements in the assembly.

In the following, different types of SIW ports and the use of filters will be discussed. As shown in FIG. 9, for both types of antenna arrangements 1'*a*, 1'*b*, the SIW port 12 is connected to a SIW duplex filter 14*a*, 14*b*, having a Tx (transmitting) branch 14*a* and an Rx (receiving) branch 14*b*. The SIW duplex filter 14*a*, 14*b* is made by means of SIW technology in a previously known manner, being a direct continuation of the SIW distribution network interfaced at port 12. The Tx branch 14*a* is connected to a transmitter arrangement 15 and the Rx branch 14*b* is connected to a receiver arrangement 16.

Figure 10:
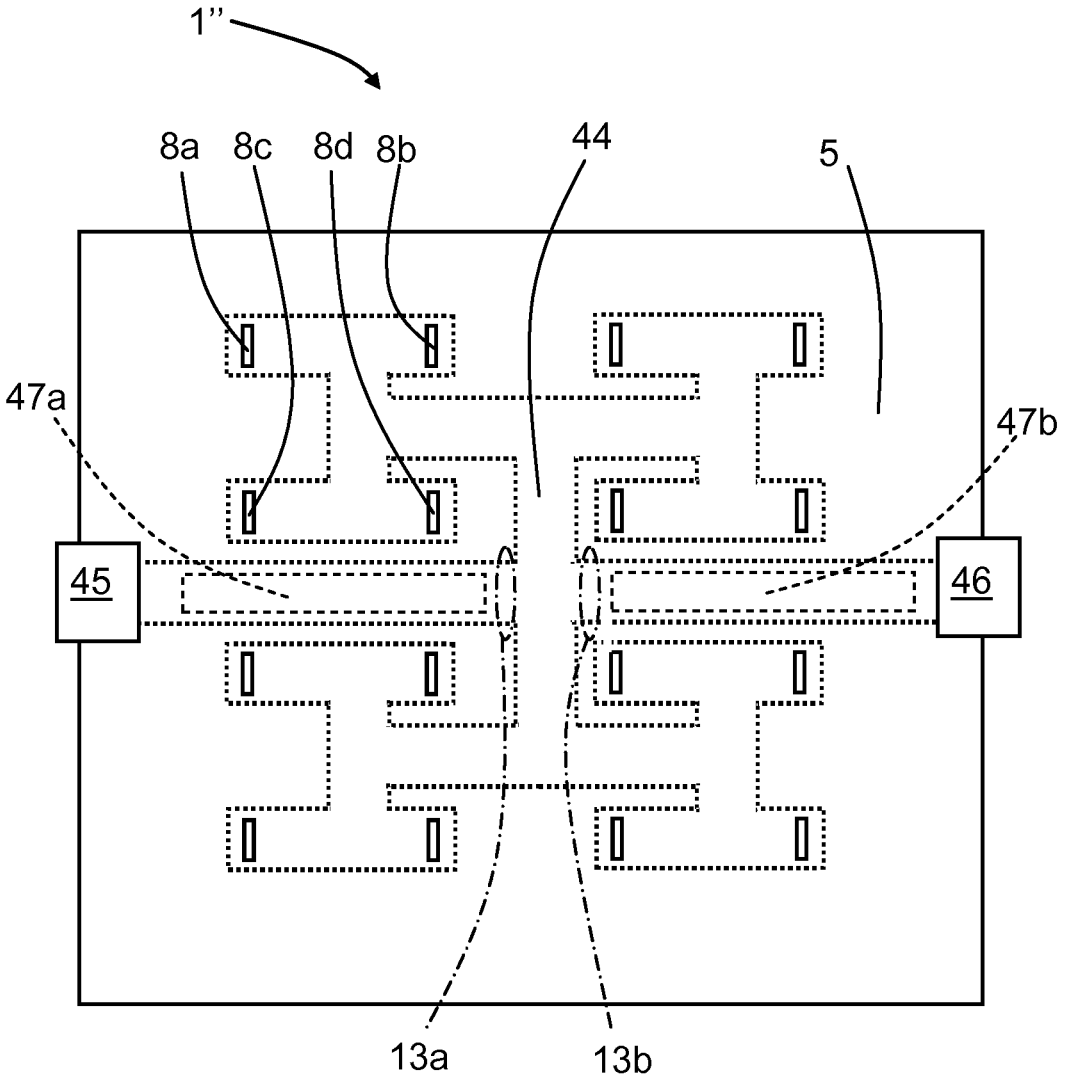
FIG. 10 schematically shows the view of FIG. 8 with another example of a port and filter arrangement.
Figure 11:
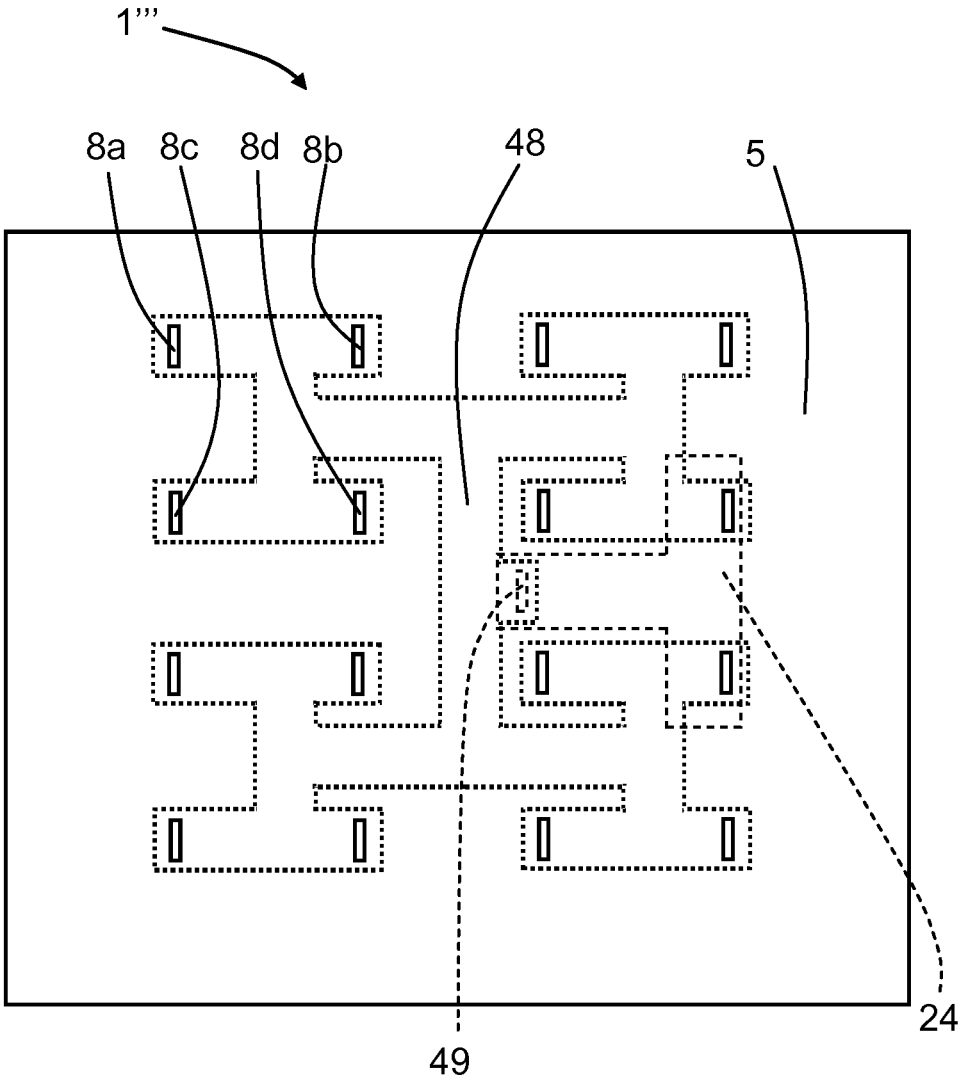
FIG. 11 schematically shows the view of FIG. 8 with yet another example of a port and filter arrangement.

In FIG. 10 and FIG. 11, for reasons of clarity, no antenna components are shown, although some type of antenna components should be positioned over the coupling apertures for a complete antenna arrangement.

FIG. 10 discloses an antenna arrangement 1" with an alternative SIW distribution network 44 with a first SIW port 13*a* and a second SIW port 13*b*. The first SIW port 13*a* is connected to a duplex Tx branch 47*a* which in turn is connected to a transmitter arrangement 45. The second SIW port 13*b* is connected to a duplex Rx branch 47*b* which in turn is connected to a receiver arrangement 46. The SIW duplex filter 47*a*, 47*b* comprises two band-pass filters 47*a*, 47*b* connected at a four-way crossing at a central location in the distribution network to the SIW ports 13*a*, 13*b*.

FIG. 11 discloses an antenna arrangement 1''' with an alternative SIW distribution network 48 with a SIW waveguide port 49, constituting a waveguide interface, which SIW waveguide port 49 comprises an opening in the second metal layer 6 and is connected to any kind of duplexer 24 with a waveguide interface, mounted to the second metal layer 6, i.e. from the non-radiating side of the antenna arrangement. The duplexer 24 may be connected to corresponding radio arrangements (not shown).

It is to be noted that which kind of duplexer 24 the SIW waveguide port 49 is connected to depends on which kind of waveguide interface that the SIW waveguide port 49 constitutes. If the waveguide port 49 is intended to be connected to a surface-mounted duplex filter, the SIW waveguide port 49 comprises a suitable transition from a SIW to a surface-mounted waveguide. If the SIW waveguide port 49 is in the form of a standard waveguide port, it may be connected to any type of duplex filter with a standard waveguide interface. Such waveguide interfaces are commonly known, and the waveguides are here normally air-filled.

The SIW waveguide port 49 is shown to be accessed from the second metal layer 6, the duplex filters connected to the SIW waveguide port 49 being positioned facing the second metal layer 6, on the opposite side of the antenna components. However, the SIW waveguide port 49 may alternatively face the other direction, such that is comprises an opening the first metal layer 5. In that case, the SIW waveguide port 49 and the duplex filters have to be mounted away from the antenna components, for example at an approximate position corresponding to the ports 14*a* and 14*b* in FIG. 9.

Figure 12:
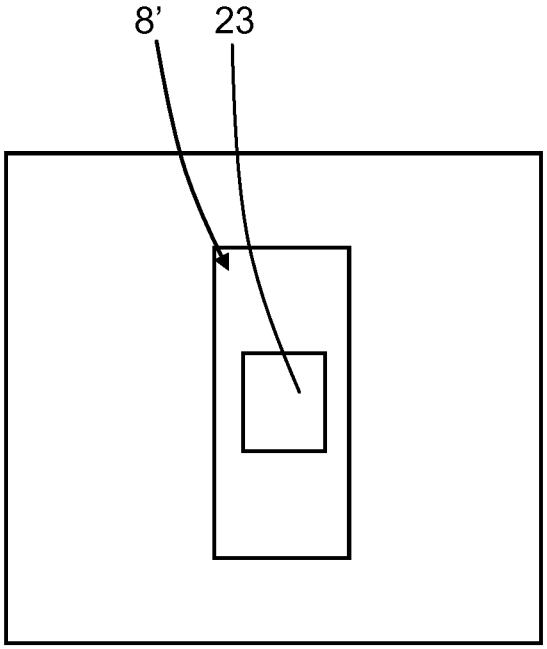
FIG. 12 schematically shows a top view of an alternative coupling aperture.

FIG. 12 discloses an alternative coupling aperture, here each coupling aperture 8' comprises at least one electrically conducting patch 23 formed within the aperture.

Figure 13:
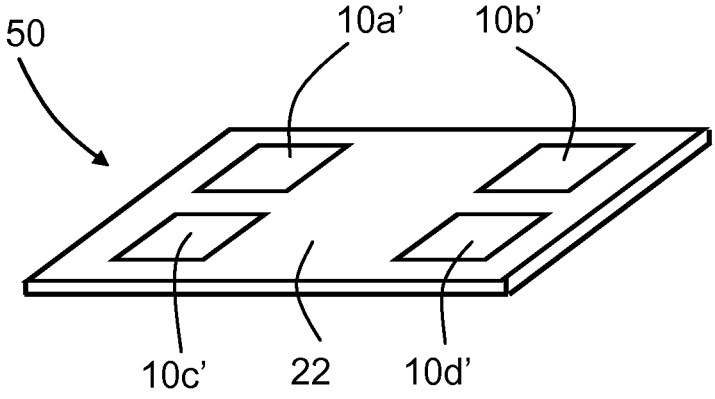
FIG. 13 schematically shows a perspective view of an alternative antenna component comprising radiating patches.

FIG. 13 discloses an alternative antenna component 50, where patches are used instead of slots. Each antenna component 50 comprises a dielectric material layer 22, and the radiating elements are in the form of electrically conducting patches 10*a*', 10*b*', 10*c*', 10*d*' formed on the dielectric material layer 22. This alternative antenna component 50 is placed over the coupling apertures 8*a*, 8*b*, 8*c*, 8*d* in the same way as the preciously described antenna components with slots. This alternative antenna component 50 may also be of different sizes, with different number of patches.

In the present invention, an ordinary circuit board is combined with a SIW distribution network with uncomplicated antenna components 9, 9', 50 that are put on top of the circuit board. Preferably, but not necessarily, components are mounted in an SMT production line as mentioned previously. In order to assure good alignment accuracy between the board and the antenna components 9, 9', 50, a complete antenna arrangement, that constitutes an array antenna, is built by putting several components, side by side, on one and the same board.

An advantage of the present invention is that multiple dielectric layers are not needed in the board. It is of course possible to add dielectric layers, either on the backside or on the top-side. Furthermore, integration of duplex filters and RF-circuits can conveniently be made directly in the antenna. Filters can be made in SIW technology or as surface-mounted components for better performance. By making a 4-port SIW filter, like in FIG. 10, it is possible to reduce size and loss. It is also possible to make a transition to regular waveguide and have the antenna port on the backside.

Figure 14:
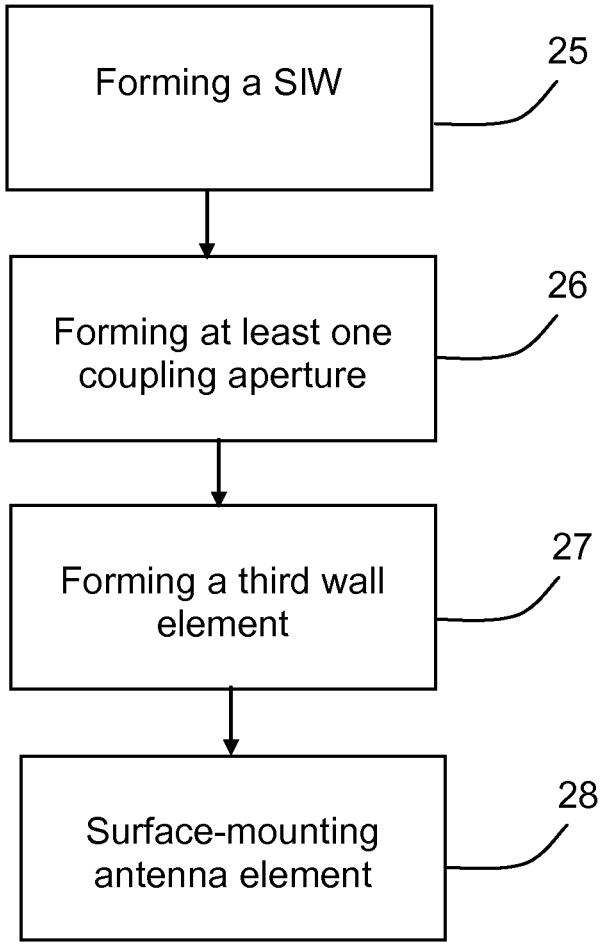
FIG. 14 shows a flowchart for a method according to the present invention.

With reference to FIG. 14, the present invention also relates to a method for assembling an antenna arrangement 1, the method comprising the step:

25: forming a substrate integrated waveguide 2, SIW, with at least one radiating arrangement 3, the SIW having a dielectric material 4, a first metal layer 5, a second metal layer 6 and an electric wall element arrangement 7*a*, 7*b*, 7*c*. The dielectric materiel 4 has a layer thickness $t_d$ and is positioned between the first metal layer 5 and the second metal layer 6. The electric wall element arrangement 7*a*, 7*b*, 7*c* comprises a first electric wall element 7*a* and a second electric wall element 7*b*, the first electric wall element 7*a* and the second electric wall element 7*b* at least partly running mutually parallel, separated by a SIW width $w_s$, in a SIW longitudinal extension $e_s$ and electrically connecting the first metal layer 5 with the second metal layer 6. Microwave signals are arranged to propagate along the SIW longitudinal extension $e_s$ in a confinement limited by at least the first metal layer 5, the second metal layer 6, the first electric wall element 7 and the second wall element 7*b*.

The method further comprises the steps:

26: for each radiating arrangement (3), forming at least one coupling aperture 8 in the first metal layer 5, and

27: for each coupling aperture 8, forming a third wall element 7*c* running between the first electric wall element 7*a* and the second wall element 7*b*, across the SIW longitudinal extension $e_s$.

For each radiating arrangement (3), the method further comprises the step:

28: surface-mounting an at least partly electrically conducting antenna component 9 with at least four radiating elements 10*a*, 10*b*, 10*c*, 10*d* on at least one coupling aperture 8.

The present invention is not limited to the examples described above, but may vary freely within the scope of the appended claims. For example, many other types of antenna components and manufacturing methods are conceivable. For example:

Slotted enclosure cavities machined out of a block of metal.

Piece of circuit board with conductive layers and vias to form cavities with slots.

Metalized molded plastic enclosure cavity with slots.

Each antenna components can have waveguides in different orientations, as well as radiating elements such as slots in various directions, and coupling apertures can be oriented in any direction and have any suitable shape. The antenna components 9 may thus be made in a metal or be formed in a plastic material and covered inside and/or outside by an electrically conducting coating. The antenna components may also be in the form of patches or other radiating elements such as dipoles or loops formed on a dielectric material. The antenna components are at least partly electrically conducting.

As mentioned above, transmitter arrangements 45 and receiver arrangements 46 may be connected to SIW ports, these and other RF circuits can be integrated on the same board as the antenna arrangement.

Each antenna components can have waveguides in different directions, as well as slots in various directions as mentioned previously.

The electric wall element arrangement has been shown comprising a plurality of via connections. Other alternatives are possible, such as plated trenches or plated slots, which may be in the form of extended vias, running through the dielectric material 4, electrically connecting the first metal layer 5 to the second metal layer 6.

The first electric wall element 7*a* and the second electric wall element 7*b* at least partly run mutually parallel, there may be bends or width changes for example in the form of irises or similar, the SIW width $w_s$ being changed between different values.

Each SIW port 49 may be in the form of a waveguide interface formed in any one of the metal layers 5, 6.

Each SIW port 12, 13*a*, 13*b*, 49 is connected to a transmitter arrangement 15 and/or a receiver arrangement 16, either directly or via a duplex filter 14*a*, 14*b*; 24, 47*a*, 47*b*.

There can be any suitable number of coupling apertures, and they may be arranged in many configurations, for example forming a circular antenna.

Some branches 38, 39, 40 in the SIW distribution network 11, 44, 48 may comprise additional vias positioned in the signal propagation path, and can be placed for matching purposes, for example for increasing the bandwidth.

Each antenna component is a component that is prefabricated independently of the SIW.

The invention claimed is:

1. An antenna arrangement comprising:

a substrate integrated waveguide, SIW, with at least one radiating arrangement, the SIW comprising a dielectric material, a first metal layer, a second metal layer and an electric wall element arrangement, wherein the dielectric material has a layer thickness ($t_d$) and is positioned between the first metal layer and the second metal layer, wherein the electric wall element arrangement comprises a first electric wall element and a second electric wall element, the first electric wall element and the second electric wall element at least partly running mutually parallel, separated by a SIW width ($w_s$), in a SIW longitudinal extension ($e_s$) and electrically connecting the first metal layer with the second metal layer, microwave signals being arranged to propagate along the SIW longitudinal extension ($e_s$) in a confinement limited by at least the first metal layer, the second metal layer, the first electric wall element and the second wall element, and wherein, for each radiating arrangement, the antenna arrangement comprises at least one coupling aperture in the first metal layer, and for each coupling aperture there is a third wall element running between the first electric wall element and the second wall element, across the SIW longitudinal extension ($e_s$); and for each radiating arrangement, the antenna arrangement further comprising an at least partly electrically conducting antenna component, wherein the antenna component comprises a multiple of four radiating elements and is surface-mounted with self-alignment on the first metal layer, enclosing the at least one coupling aperture, wherein the antenna component comprises four radiating elements or each enclosed coupling aperture, and wherein, for each radiating arrangement, electromagnetic signals are arranged to be transmitted between said coupling aperture and said radiating elements.

2. The antenna arrangement according to claim 1, wherein the antenna arrangement comprises a SIW distribution network and at least one SIW port, the distribution network being arranged to transfer signals between each SIW port and a plurality of coupling apertures.

3. The antenna arrangement according to claim 2, wherein the antenna arrangement comprises a SIW duplex filter connected to said port.

4. The antenna arrangement according to claim 2, wherein the antenna arrangement comprises a surface-mounted duplex filter connected to said port.

5. The antenna arrangement according to claim 3, wherein said SIW port is in the form of a waveguide interface formed in one of the metal layers.

6. The antenna arrangement according to claim 5, wherein the antenna arrangement comprises a duplex filter with a waveguide interface, which filter is connected to said port.

7. The antenna arrangement according to claim 2, wherein each SIW port is connected to one or more of a transmitter arrangement and a receiver arrangement, either directly or via a duplex filter.

8. The antenna arrangement according to claim 1, wherein each antenna component comprises a cavity defined by at least partly electrically conducting walls, the radiating elements being in the form of slots in one of said walls.

9. The antenna arrangement according to claim 1, wherein each antenna component comprises a dielectric material layer, the radiating elements being in the form of electrically conducting patches formed on the dielectric material layer.

10. The antenna arrangement according to claim 1, wherein each coupling aperture comprises at least one electrically conducting patch formed within the aperture.

11. The antenna arrangement according to claim 1, wherein each antenna component is attached to the first metal layer by solder joints.

12. The antenna arrangement according to claim 1, wherein the one said walls of each antenna component comprises matching steps protruding into the cavity.

13. A method for assembling an antenna arrangement, the method comprising the steps:

forming a substrate integrated waveguide, SIW, with at least one radiating arrangement, the SIW having a dielectric material, a first metal layer, a second metal layer and an electric wall element arrangement, wherein the dielectric material has a layer thickness ($t_d$) and is positioned between the first metal layer and the second metal layer, and wherein the electric wall element arrangement comprises a first electric wall element and a second electric wall element, the first electric wall element and the second electric wall element at least partly running mutually parallel, separated by a SIW width ($w_s$), in a SIW longitudinal extension ($e_s$) and electrically connecting the first metal layer with the second metal layer, microwave signals being arranged to propagate along the SIW longitudinal extension ($e_s$) in a confinement limited by at least the first metal layer, the second metal layer, the first electric wall element and the second wall element;

for each radiating arrangement, forming at least one coupling aperture in the first metal layer, and for each coupling aperture, forming a third wall element running between the first electric wall element and the second wall element, across the SIW longitudinal extension ($e_s$), wherein, for each radiating arrangement, the method further comprises the step:

surface-mounting an at least partly electrically conducting antenna component comprising a multiple of four radiating elements on at least one coupling aperture, wherein self-alignment is used for the surface-mounting, enclosing the at least one coupling aperture, and wherein the antenna component comprises four radiating elements for each enclosed coupling aperture.

14. The method according to claim 13, wherein each antenna component is mounted in a pick-and place process.

* * * * *